United States Patent [19]

Grimm et al.

[11] 4,381,160

[45] Apr. 26, 1983

[54] POST SUPPORT BRACKET ASSEMBLY

[76] Inventors: William G. Grimm, 29974 Paint Brush Dr., Evergreen, Colo. 80439; Ronald W. Pott, 730 Crescent La., Lakewood, Colo. 80215

[21] Appl. No.: 297,493

[22] Filed: Aug. 28, 1981

[51] Int. Cl.[3] ..... B25G 3/00; F16B 7/08; F16B 9/00

[52] U.S. Cl. ..... 403/230; 403/189; 403/217; 52/298; 256/24; 248/357

[58] Field of Search ..... 403/187, 189, 406, 230; 248/357, 519, 539; 52/298, 243; 256/24, 21; 404/10; 40/607, 606, 608

[56] References Cited

U.S. PATENT DOCUMENTS

| | | | |
|---|---|---|---|
| 910,765 | 1/1909 | Adelman | 403/189 X |
| 1,089,878 | 3/1914 | Steinhauser | 403/406 X |
| 1,214,738 | 2/1917 | Wolf | 403/187 X |
| 1,232,963 | 7/1917 | Parkins | 248/519 X |
| 1,837,630 | 12/1931 | Pawling | 52/243 X |
| 2,820,262 | 1/1958 | Dunn | 52/298 |

FOREIGN PATENT DOCUMENTS

| | | | |
|---|---|---|---|
| 1805206 | 6/1969 | Fed. Rep. of Germany | 52/298 |
| 132295 | 9/1919 | United Kingdom | 403/187 |

*Primary Examiner*—Wayne L. Shedd
*Attorney, Agent, or Firm*—John E. Reilly

[57] ABSTRACT

A corner bracket assembly is adapted for mounting and support of a newel or post and comprises a plurality of corner brackets each having oppositely directed flanges at its lower edge for attachment to a rigid member, such as, a floor surface so as to form an upstanding receptacle for insertion of the newel, and exterior molding or trim forms a cover in surrounding relation to the corner brackets and base portion of the newel.

14 Claims, 4 Drawing Figures

POST SUPPORT BRACKET ASSEMBLY

This invention generally relates to supporting brackets and more particularly to a novel and improved corner bracket assembly adapted for use in supporting newel posts or like members in abutting relation to another member.

BACKGROUND AND FIELD OF THE INVENTION

A variety of structures require the joining of the end of one member in abutting relation to another normally disposed member and in such a way as to be rigidly attached and capable of withstanding externally applied loads or forces to the one member as well as to form a support for other elements to be secured to the one member. The present invention may be best typified by its use in conjunction with staircase and other handrail assemblies which require terminal end posts or newels and, in many cases, intermediate posts to support the horizontal or inclined rail sections. The posts must be anchored to the floor; however, in the past it has been difficult to rigidly secure same as to avoid eventual loosening under repeated use and application of forces. Previously, it has been customary practice to cut through the floor or tread and anchor the newel to a frame member beneath the floor or to the stair framing. In order to avid the time and expense required in securing beneath the floor, attempts have been made to secure the newel by pigtailing into the floor or by anchoring with a bracket. Generally, these approaches have not proven to be satisfactory particularly where the post is subject to sidewise loading or jarring such as that which occurs when a person grasps the handrail assembly or supports himself against it.

Moreover, winding staircases and handrails have become increasingly popular as ornamental items. In such applications, it is highly desirable that the post be anchored securely to the floor in such a way so as to permit placement of decorative trim especially around the base both to ornament or decorate the post and to cover and protect the fastening elements.

SUMMARY OF THE INVENTION

It is therefore an object of the present invention to provide for a novel and improved support bracket assembly specifically adaptable for use in anchoring the end of one member in flush abutting relation to another normally extending member.

Another object of the present invention is to provide for a novel and improved support bracket assembly for a post which will permit anchoring of the post to another surface, such as, a floor surface without the insertion of fastening elements through the post directly into the floor.

A further object of the present invention is to provide a novel and improved corner bracket assembly for different sized posts of rectangular or other polygonal cross-section which will securely anchor the post in abutting relation to a floor or similar support surface.

It is an additional object of the present invention to provide for a novel and improved corner bracket assembly adapted to support and anchor a post to a floor surface as well as to support decorative trim or molding in outer surrounding relation to the corner bracket assembly; and further wherein the bracket assembly is conformable for use with various types of handrail assemblies to serve as anchoring means for terminal and intermediate newel posts between the rail sections.

A preferred embodiment of the present invention resides in a corner bracket assembly adapted for the mounting and support of a newel post to a floor at spaced intervals between handrail sections which are suspended from and between the posts. Each corner bracket has a pair of upright flat plates joined together in mutually perpendicular relation to one another with oppositely directed flanges at intervals along the bottom edge or bases of the plates, and which flanges are fastened directly to the floor surface. The spacing between corner brackets, for example, for a rectangular post, is of course dictated by the cross-sectional size of the post so that a common receptacle or opening is formed between the brackets for close-fitting insertion of the base of the post. Decorative molding may be united to the external surface of the corner bracket plates so as to cover the plates and to form an attractive base for the post.

The above and other objects, advantages and features of the present invention will become more readily appreciated and understood from a consideration of the following detailed description of a preferred embodiment of the present invention when taken together with the accompanying drawings of a preferred embodiment of the present invention, in which:

DETAILED DESCRIPTION OF THE PREFERRED EMBODIMENT

Figure 1:
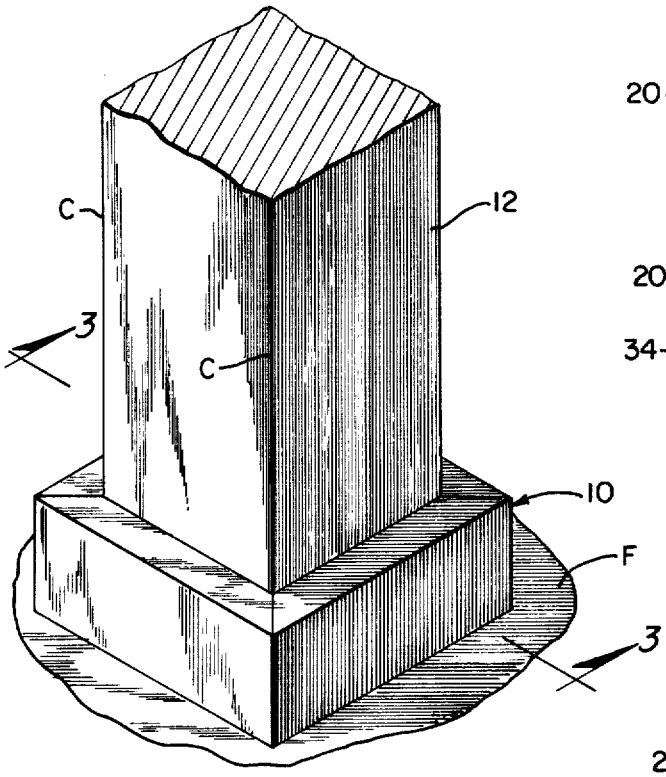
FIG. 1 is a somewhat fragmentary persective view of an assembled corner bracket assembly and post in accordance with the present invention.

Referring in detail to the drawings, there is shown by way of illustrative example in FIG. 1, the mounting and disposition of a preferred form of corner bracket assembly as generally represented at 10 to a floor surface F and specifically for the purpose of mounting and disposition of a support post or newel 12 in upstanding relation. In the preferred embodiment, the corner bracket assembly 10 is specifically intended for use in supporting a generally rectangular or square post, for example, to serve as one of the newels in a handrail assembly. Typical handrail assemblies are disclosed in U.S. Pat. No. 4,112,195 as well as in our hereinbefore referred to application for patent, Ser. No. 229,888, filed Jan. 30, 1981. As the description proceeds, however, it will become evident that the corner bracket assembly may be used in anchoring or supporting various members other than posts in abutting relation to another member, such as, a floor surface F; and further is conformable for use in supporting posts or members of different cross-sections.

Figure 4:
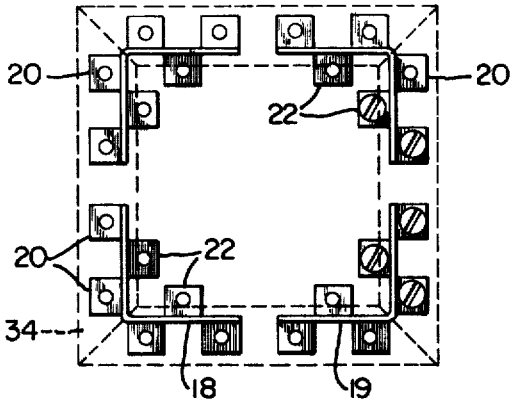
FIG. 4 is a plan view with the post removed of the preferred form of corner bracket assembly.
Figure 2:
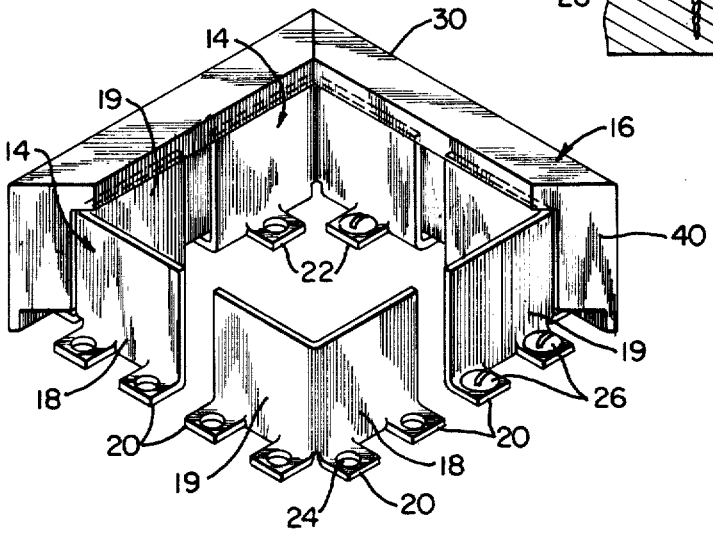
FIG. 2 is a perspective view of a preferred form of corner bracket assembly with portion broken away to illustrate the interrelationship between corner brackets and trim comprising the assembly.

Referring to FIGS. 2 and 4, the preferred form of corner bracket assembly 10 is seen to comprise a plurality of four corner brackets 14 with decorative trim as generally represented at 16 disposed in outer surrounding relation to the inner brackets 14. Each bracket is made up of a pair of flat, upstanding wall sections or plates 18 and 19 interconnected along a common edge in mutually perpendicular relation to one another. In turn, each plate has oppositely directed, inwardly and outwardly extending feet in the form of flanges, there being a pair of spaced, parallel outwardly directed flanges 20 from the lower edge of each plate 18 and 19 and an inwardly directed flange 22 which is directed inwardly from an intermediate portion of the plate between and in an opposite direction to that of the flanges 20. Each flange 20 and 22 is provided with an opening or aperture 24 to permit insertion of a suitable fastener, such as, a wood screw as represented at 26 to secure the flanges 20, 22 into the floor surface.

It will be seen that adjacent brackets have spaced parallel sides 18 and 19, the spacing between adjacent sides being dictated by the cross-sectional size of the posts 12. Thus, for a square or rectangular post, adjacent brackets are positioned or spaced such that the distance between corners along inside surfaces of the plates corresponds to the distance between the corners C, as represented at FIG. 1, of the support post 12.

The wall or plate sections 18 and 19 of each corner bracket assembly are dimensioned in height so as to form a solid unyielding support for the base of the post. The post, being sized for close-fitting insertion within the brackets, will then come to rest upon the inwardly directed flanges 22, the only connection or fastening required being that through the flanges 20 and 22 of the corner brackets into the floor F.

Figure 3:
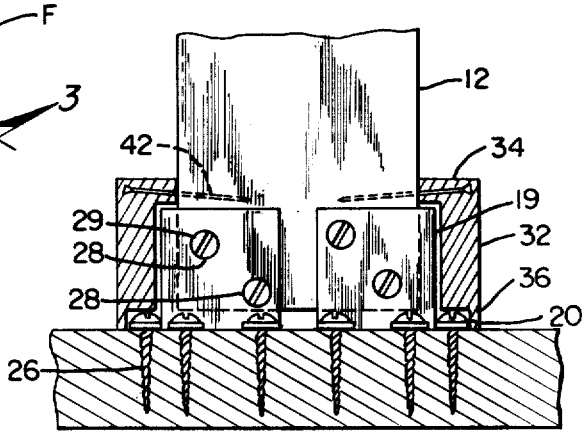
FIG. 3 is a cross-sectional view taken about lines 3—3 of FIG. 1.

The assembly illustrated in FIG. 3 corresponds to that of FIG. 2, but is modified somewhat in the provision for openings 28 in each of the plates to permit threaded insertion of wood screws 29 through the openings into the body of the post.

As illustrated in FIGS. 1 to 4, the outer decorative trim as broadly designated at 16 is made up of four sections 30 each having an intermediate wall section 32 dimensioned to correspond to the height of the plates 18 or 19, an overhanging lip or ridge 34 at the upper edge to extend over the upper edge of each plate into abutting relation to the external sides of the post 12, and a lower, vertically extending lip 36 which extends from the lower edge of the wall section over the outwardly directed flanges 20. Opposite ends of each section 30 are formed with beveled edges 40 so as to form complementary abutting edges between adjacent sections 30. If desired, the trim sections may be fastened directly to the base of the post by means of suitable fasteners in the form of nails 42 which are driven through the upper ends 34 of the trim sections into the body of the post.

Again, as alluded to earlier, the bracket assembly of the present invention is readily conformable for other anchoring applications as well as to other cross-sectional configurations and sizes of the member to be anchored. For instance, a pair of corner brackets may be used in cooperation with one another for smaller cross-sectional sized posts. Arcuate brackets may be formed with attaching feet to surround a circular or similar cross-sectional configuration of posts and may be provided with correspondingly arcuate molding or trim to cover and protect the base of the post. Moreover, the decorative trim may be integrally formed with the brackets, for example, where the bracket assembly is to be used for known cross-sectional size of post or other member to be anchored. In this same relation, the corner bracket members need not be formed of separate corner brackets but in the alternative may be in the form of a common rectangular plate having upstanding wall or plate sections to extend along each side of the post and oppositely directed base flanges to affix the common rectangular frame to the floor or other surface. Moreover, while the preferred form of invention has been described specifically in reference to anchoring of a wooden post to a floor surface, it will be apparent that the bracket assembly has ready application for use with other materials.

It is therefore to be understood that various other modifications and changes may be made in the present invention without departing from the spirit and scope thereof as defined by the appended claims.

I claim:

1. A corner bracket adapted for anchoring one member in flush abutting relation to another member comprising:

a pair of upstanding plates joined in mutually perpendicular relation to one another, oppositely directed, horizontal flanges disposed for extension from lower edges of said plates, and fastener means for fastening said flanges to the other member.

2. A corner bracket according to claim 1, said flanges alternately extending in opposite horizontal directions from said lower edges of said plates.

3. A corner bracket according to claim 1, said plates dimensioned to extend a substantial distance across the width of said one member.

4. A corner bracket according to claim 1, there being a plurality of corner bracket assemblies disposed in surrounding relation to said one member.

5. A support post bracket adapted for anchoring the lower end of a support post in flush abutting relation to a floor surface, said bracket comprising an upstanding wall section substantially circumscribing the lower end of said post and having a lower edge co-terminal with the lower edge of said post; and horizontal flanges extending horizontally from said lower edge including inwardly directed flanges extending between said support post and floor surface and outwardly extending flanges extending away from said support post, and means for fastening said flanges to the floor surface.

6. A support post bracket according to claim 5, including trim sections secured to said wall section in outer surrounding relation thereto.

7. A support post bracket according to claim 5, said wall section defined by a pair of flat plates interconnected along a common vertical edge in mutually perpendicular relation to one another.

8. A support post bracket according to claim 5, including wall fastening means for fastening said wall section to said support post, and an outer trim section disposed in surrounding relation to said wall section.

9. A corner bracket assembly adapted for anchoring the lower end of the newel post in flush perpendicular relation to a floor surface and the like in which said support post has a lower end of generally rectangular cross-section with vertically extending corners between adjoining sides, said corner bracket assembly comprising:

a plurality of corner brackets, each corner bracket including a pair of upstanding relatively flat plates extending in mutually perpendicular relation to one another away from a common corner formed therebetween, each plate being sized to traverse less than one half the distance between adjacent corners at the lower end of said support post, oppositely directed horizontal flanges disposed for extension from lower edges of each of said plates including inwardly directed flanges extending between the lower end of said support post and said floor surface and outwardly directed flanges extending away from the lower end of said support post, and fastener means for securing said flanges to said floor surface.

10. A corner bracket assembly according to claim 9, there being a corner bracket at each corner of the lower end of said support post with said plates of each corner bracket extending along an external surface of said support post between said corners, and wall fastening means for securing said plates of each corner bracket to said external surface at the lower end of said support post.

11. A corner bracket assembly according to claim 9, including exterior molding disposed in surrounding relation to and contoured to conform to the external configuration of a pair of aligned adjoining plates between adjoining corners at the lower end of said post.

12. A corner bracket assembly according to claim 11, including fastener means to secure said molding to said support post in surrounding relation to said plates.

13. A corner bracket assembly according to claim 9, with alternate flanges extending in opposite directions from a common lower edge of said plates, and said fastener means for said flanges defined by wood screws extending through openings in said flanges into said floor surface.

14. A corner bracket assembly according to claim 13, each flange being relatively flat and sized for extension a limited distance away from the lower edge of its associated plate.

* * * * *